United States Patent [19]

Gerber et al.

[11] 4,274,367

[45] Jun. 23, 1981

[54] RECIPROCATING PISTON BEAM ENGINE

[75] Inventors: Alfred Gerber, Susenbergstrasse 191, Zürich, Switzerland; Francesco Sparro, Les Tuileries de Grandson, Switzerland

[73] Assignee: Alfred Gerber, Zürich, Switzerland

[21] Appl. No.: 904,242

[22] Filed: May 9, 1978

[30] Foreign Application Priority Data

| | | | |
|---|---|---|---|
| May 11, 1977 | [CH] | Switzerland | 5913/77 |
| May 11, 1977 | [CH] | Switzerland | 5914/77 |
| Jul. 14, 1977 | [CH] | Switzerland | 8733/77 |

[51] Int. Cl.[3] ..... F02B 75/26

[52] U.S. Cl. ..... 123/52 A; 74/661; 123/54 A; 123/56 AB; 123/198 F; 60/701; 60/718

[58] Field of Search ..... 123/52 R, 52 A, 61 R, 123/63, 56 R, 56 AB, 56 BB, 56 A, 56 B, 18 R, 18 A, 58 R, 197 R, 197 A, 197 AB, 197 AC, 198 F, DIG. 8, 54 A; 60/700, 701, 709, 716, 718; 74/661

[56] References Cited

U.S. PATENT DOCUMENTS

| | | | |
|---|---|---|---|
| Re. 14,347 | 8/1917 | Paige | 123/54 A |
| 558,943 | 4/1896 | Gardner | 123/54 A |
| 898,103 | 9/1908 | Heermans | 123/56 BB |
| 1,256,647 | 2/1918 | Baudot | 123/18 A |
| 2,101,556 | 12/1937 | Morgan | 123/63 |
| 4,011,842 | 3/1977 | Davies et al. | 123/61 R |
| 4,069,803 | 1/1978 | Cataldo | 123/198 F |

FOREIGN PATENT DOCUMENTS

| | | | |
|---|---|---|---|
| 1094104 | 12/1960 | Fed. Rep. of Germany | 60/716 |
| 317902 | 3/1903 | France | 123/18 A |

*Primary Examiner*—Craig R. Feinberg
*Attorney, Agent, or Firm*—Toren, McGeady and Stanger

[57] ABSTRACT

In the disclosed internal combustion engine opposing identical pairs of pistons drive back and forth arm ends of a centrally pivoted beam which is symmetrical about its pivot. Torque is extracted from the beam through an eccentric mechanism which is located between the end of one arm and the pivot. The other arm is provided with a symmetrically located second eccentric mechanism symmetrically spaced from the pivot and substantially identical with the first as regards the dynamic balancing, but not connected to the same output shaft as is the first eccenter mechanism. Also disclosed are combinations in which two or more such engines are connected together as units so that one or more of the units may be completely decoupled from the output shaft and thus inactivated. A special controllable coupling connecting the main shafts of such multiple units permits selective disengagement of the units and synchronized reengagement with predetermined relative angular orientation. Lubrication of the beam pivot is particularly effective when the beam is pivoted on the rotating output shaft of the engine, since that permits an effective lubricant film to be maintained.

23 Claims, 5 Drawing Figures

RECIPROCATING PISTON BEAM ENGINE

BACKGROUND OF THE INVENTION

The present invention relates generally to reciprocating piston engines and more particularly, but not exclusively, to internal combustion engines of such a type.

At the present time the great majority of engines which provide power for motor vehicles are reciprocating piston engines in which the pistons and their connecting rods rotate a crankshaft.

Since most internal combustion engines of the reciprocating piston type can, within limits, provide a greater power output for their weight at higher speeds of revolution than at lower ones, the emphasis in the development of such engines has for many years been on increasing the permissible working speed of the most critical element in this regard, namely the crankshaft.

Reasonably well-balanced crankshafts for high speed engines have required a lengthy development period, and even with the sophisticated mass production techniques of today are still a highly critical and expensive element of the engine which is a determining factor in its maximum working speed and cost. At high speeds the main bearings of the crankshaft and the connecting rod bearings are subjected to enormous stresses which result in substantial frictional losses, with resultant heating and greatly increased wear. The magnitude and effect of such stresses are discussed in detail in numerous technical publications and well known.

The back-and-forth pivoting of the connecting rods relative to the piston as one end of the rods follows the cranks of the crankshaft is the source of a further significant frictional loss arising from the resulting oscillating tilting torque on the pistons which presses the piston skirts against the cylinder wall. At high engine speeds particularly, the force of the pistons against the rod end is so great that the friction between the piston and the cylinder wall resulting from this tilting torque is increased dramatically, and the pistons and cylinder walls can be subjected to severe wear. Even at normal working speeds, this friction results in a substantial reduction in power. Furthermore, the oscillating tilting torque on the piston sets up vibrations in the cylinder walls which contribute a large part of the total noise from the engine.

The above problems are avoided with gas turbines and other types of engines, such as the Wankel engine, for example, which do not use a crankshaft. Gas turbine engines, however, have proved too costly for use in ordinary passenger cars, while the Wankel engine has certain other disadvantages.

There are also known reciprocating piston engines which avoid the use of a crankshaft. One such engine, for example, is what may be referred to as a reciprocating piston beam engine. In this engine, one or a pair of pistons are connected to the end of one arm of a pivoted beam to cause the end of the beam arm to oscillate back and fourth. The end of the other arm of the beam can then be used to drive a load back and forth, as for a pump, or even to rotate an output shaft by means of an eccenter mechanism. By choosing the distance between the pivot of the beam and the end where it is driven by the pistons to be sufficiently long, the oscillating tilting torque on the pistons can be greatly decreased. Also, by connecting the arm end to the center of a connecting rod rigidly connecting two opposing pistons, the tilting torque on the pistons can be effectively eliminated, since they then act as a single very long piston and provide a large mechanical advantage against the torque. Beam engines have been developed with the pistons being powered by steam pressure or by internal combustion. However, such known beam engines have thus far not been capable of working at a high speed, because of either balancing or lubrication difficulties.

A reciprocating piston beam engine having a high enough power-to-weight ratio to be feasible for use in ordinary mass-produced passenger automobiles must be capable of continuous operation at high speeds while minimizing at such speeds the effects of friction and vibration, without requiring for this substantially greater cost of manufacture than for present engines.

DETAILED DESCRIPTION AND GENERAL DISCUSSION

In a novel engine in accordance with the present invention opposing pairs of cylinders drive the ends of a centrally pivoted beam back and forth. Torque is extracted from the beam through an eccentric mechanism which is located between the end of the beam and the pivot point of the beam. This permits the power to be taken from the beam and converted to rotary motion with a minimum of friction from bearings and with a minimum of parts which require balancing. The eccentric mechanism is balanced by having to the other side of the pivot a symmetrically located and oppositely moving 180° displaced second eccentric mechanism substantially identically matched with the first as regards the dynamic balancing, but not connected to the same output shaft as is the first eccentric mechanism. As a result, the combined center of mass of the various movable parts of the engine in any working position lies on the axis of the beam pivot. The locking effect which would result from having the second eccentric mechanism be in a dead position on starting of the engine can be avoided by coupling the rotations of the two eccenter mechanisms by, for instance, a belt or through gears. It is also possible to use a fixed counterweight instead of the second eccentric mechanism for balancing against the first eccentric mechanism. However, such an arrangement cannot provide a dynamic balance comparable to that which can be achieved with a second eccentric mechanism for balance.

The term "eccentric mechanism" as used herein is intended to include eccentric shaft, crank, and crankshaft mechanisms.

In a reciprocating engine in accordance with a preferred embodiment of the present invention, the pivot bearing axle of the beam serves also as the main output shaft of the engine. An eccenctric which is connected to the beam is connected, for example, by gears, to this main shaft to rotate it. In this way each eccentric of an engine consisting of a number of individual engine units has only a short eccentric shaft with an eccentric. Such an arrangement is readily manufactured and can be highly loaded. Since in this embodiment the bearing axle of the beam is rotatably mounted and driven, there is the further significant advantage that due to the continuous rotation of the main shaft, the beam pivot bearing surfaces can be effectively lubricated, whereas when such surfaces simply oscillate back and forth, it is difficult to build up between them the necessary load-carrying lubrication film. The main output shaft of the engine can be an eccenter shaft with its eccentric being a part of the eccentric mechanism of each of the engine units.

A further meaningful advantage arises in that the working pistons, which are always a coaxially guided pair, can be so connected that they guide each other and can therefore be designed correspondingly short and light in weight, since they need take up only the forces in the direction of the cylinder axis and to seal the cylinder. The connecting rods connecting together rigidly the two pistons of a pair can also be made much lighter than can rods of the type in a crankshaft engine, since they are not subject to any appreciable bending moments.

The connection between an end of the lever arm and a piston pair unit connecting rod can be mady by supporting the end of the arm in the inner sleeve opening of a common ball-and-socket bearing, so that the lever arm end can simultaneously slide back and forth in the inner sleeve of the bearing and also change orientation with respect to it. The sliding back and forth will then accomodate the change in the distances of the bearing point from the lever arm pivot axis due to the deviation of the piston movement from the arc movement of the end of the lever arm. The magnitude of such a deviation is typically only on the order of about one millimeter. The longer the lever arm is, the less is the deviation for a given piston travel, and the less also is the orientation change required for the ball-and-socket bearing. Thus, lengthening the lever arm has the over-all effect of reducing the transverse force components on the pistons which result from tilting torque.

Since the cylinders of the coaxially guided and equally sized pistons always present coaxially the same diameter, they can be manufactured at the same time, in one operation, and from a single workpiece.

Since two coaxial working pistons at a time can also be rigidly connected with each other with the avoidance of piston pins, and since in the absence of pivoting connecting rods for the pistons no significant transverse forces arise, the noise generation, the frictional losses, and the wear are correspondingly small. Significantly higher piston speeds, and therewith higher output, can be realized than were previously possible.

The torque output, or input, at a location between the beam pivot and one of the beam arm end regions results in a lever action which through the eccenctric mechanism attached to a beam arm results in correspondingly shorter and lower speed movement than with an arrangement having a connecting rod mechanism attached to the working pistons. Furthermore, the eccentric mechanism need transmit only the resultant forces, or useful output, since the power transmission from the piston carrying out a working strike to the other pistons is directly through the beam. It is also understandable that this power transmission between the pistons by way of the lever is associated with significantly less frictional losses than is the case for the heretofore power transmission over the crankshaft and the connecting rod mechanism of the pistons.

Through the construction of the reciprocating engine in accordance with the present invention, there are therewith presented less constraints which result in a rotational speed limitation of the engine. There can be chosen high rotational speeds which are limited only by the chosen valve construction and through the mass forces. For higher rotational speeds there can also be used, for example, a known rotary valve construction.

A reciprocating engine of this type therewith has no crankshaft with numerous cranks which correspond to the cylinder number. It follows that the working pistons, which act on the beam arm end regions, lie together with the beam in a common plane. In this way, the reciprocating engine in accordance with the invention has a relatively small length in the direction of the beam axis. Thus, a number of engine units, each with four cylinders, can work on a common main output shaft and permit the realization without construction difficulties of a compact 8-cylinder, 12-cylinder, or 16-cylinder engine. It especially requires no construction difficulties to provide a correspondingly ruggedly constructed main shaft, since the short eccentric movements permit its configuration to be segments of round, even, hollow, cylinders which need only have the appropriate large diameter.

The main output shaft for receiving the output from one or more engine units of a multiple-unit engine can be an eccenter shaft which forms a portion of the eccentric mechanism of each of the units, or it can also be a central shaft which simultaneously also acts as the beam pivot axle for all the units at once.

Due to the small frictional losses of an engine in accordance with the present invention, sufficient cooling of the cylinder walls can be provided by simply spraying oil against them from the lubricating oil supply system. Water colling for carrying off the heat of combustion can thus be limited to the cylinder heads alone. A particularly advantageous form of such an oil spray cooling of the cylinder walls can be provided by locating spray apertures in the end region of the lever arm so that the pressure-fed oil in the oil passageway in the arm which leads to oil channels in the bearing surfaces at the end of the arm is sprayed out in the desired direction to the inner cylinder walls from there.

BRIEF DESCRIPTION OF THE DRAWINGS

In the following, the invention will be described in connection with examples of embodiments shown in the drawings. There is shown.

DESCRIPTION OF THE PREFERRED EMBODIMENTS

Figure 1:
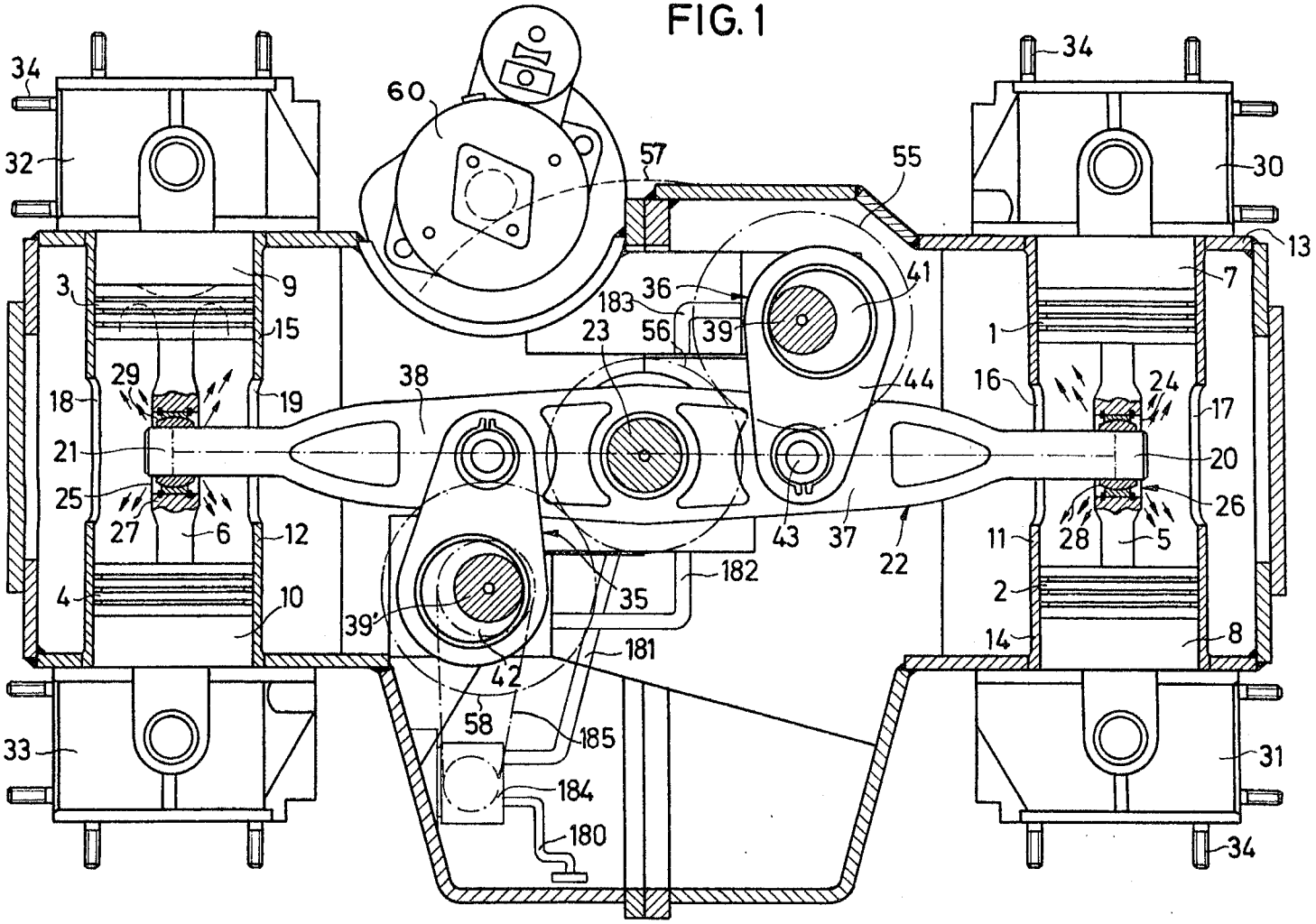
FIG. 1 a cross-sectional illustration of a novel reciprocating engine in accordance with a preferred embodiment of the present invention and taken through the four cylinders.

As can be seen from the FIG. 1, two pairs of coaxial working pistons 1,2 and 3,4 are rigidly connected with each other by a piston rod 5 and 6, respectively. The pistons have a small height in comparison to heretofore used pistons, since the two equally dimensioned coaxial pistons 1,2 and 3,4 guide each other in their respective cylinders by means of the fixed connection through the piston rod. Through the coaxial arrangement of similar pistons in opposing pairs, it follows that likewise two coaxial cylinders 7,8 or 9,10 can be made as a pair at the same time from a single workpiece to take the form of hollow cylinder pairs 11,12, respectively. Both hollow cylinder pairs are at their ends fastened to the engine housing. Either the outer or the inner surfaces of the cylinder walls 14,15 may be cooled with oil which is sprayed against the walls 14,15 from oil lines 180–183 of an oil distribution system, shown in broken lines, which is fed by an oil pump 184. The oil pump 184 is driven by a chain drive. In the middle regions of the cylinder pairs 11,12, there are provided in the cylinder walls two diametrically opposed openings 16,17 and 18,19 through which the oil can be led out to the inner space of the engine housing.

Both pairs of double pistons 1,2 and 3,4 are connected through their piston rods 5 and 6, respectively, with the arm ends 20, 21 of a two-armed beam 22 which is supported at the middle on a pivot axle 23. The back and forth movement of the piston pair units 11,12 thereby results in a reciprocating movement of the beam 22 about the pivot axle 23. Since in this the beam arm ends 20,21 take on various different angular positions with respect to the piston rods 5,6 there are provided a ball-and-socket bearing 28,29 for the rod ends 20,21 in transverse bores 24,25 of widened middle regions 26,27 of the connecting rods 5,6. For this there is particularly suitable, for example, a bearing available in 1977 from the SKF company, Zurich, Switzerland and known under the trade designation "SKF GE 25ES". For this connection between the ends of the arms and the connecting rods, various linkage constructions are suited to permitting the small transverse movement which arises from the movement of the ends of the arms 20, 21 along an arc. Due to the length of the beam 22, the extent of this transverse movement nevertheless lies in the range of only one millimeter, so that it can even be taken up by the play which is present anyway in a self-aligning bearing.

There is also possible a construction in which the pistons of a pair are not rigidly fixed together by the connecting rods 5,6, and in which each piston has its own rigid connecting rod and the rods are connected with the ends 20,21 of the arms 20, 21 by trunnion bearings. The tilting movement of the pistons which thereby arises as a result of the movement of the arms 20,21 along an arc, is then so small that the sealing of the pistons is not impaired. The cylinder heads 30,31,32,33 are adapted to the particular engine type, and correspond, for example, to the cylinder heads of an ordinary four cycle engine or a diesel engine, so that they are not shown in the drawing with all their individual details. In the eight cylinder embodiment of a four cycle engine, that is with each cylinder vertical and the cylinders arranged parallel to each other in a plane, there may be used, for example, the cylinder heads of an Alfasud engine available in 1977 from the Alfasud company of Italy. The bolts 34, visible on the cylinder head, serve for fastening the camshaft unit, not shown, for the valve control and also for the fastening of the intake and exhaust lines.

The torque output or input results through one of two eccentric mechanisms 35,36, which are linked to the arms 37,38 of the lever 22. One of the two eccenter mechanisms serves for the dynamic balancing of the mass of the other eccentric mechanism, so that the eccentrics 41,42 provided on a driven or driving eccentric shaft 39,40 are mutually oriented angularly displaced at a position which is at 180 degrees with respect to each other. In this way, the combined center of mass of the various movable parts of the piston engine is in the geometrical axis of the beam pivot 23, so that smooth running of the piston engine is assured.

Figure 2:
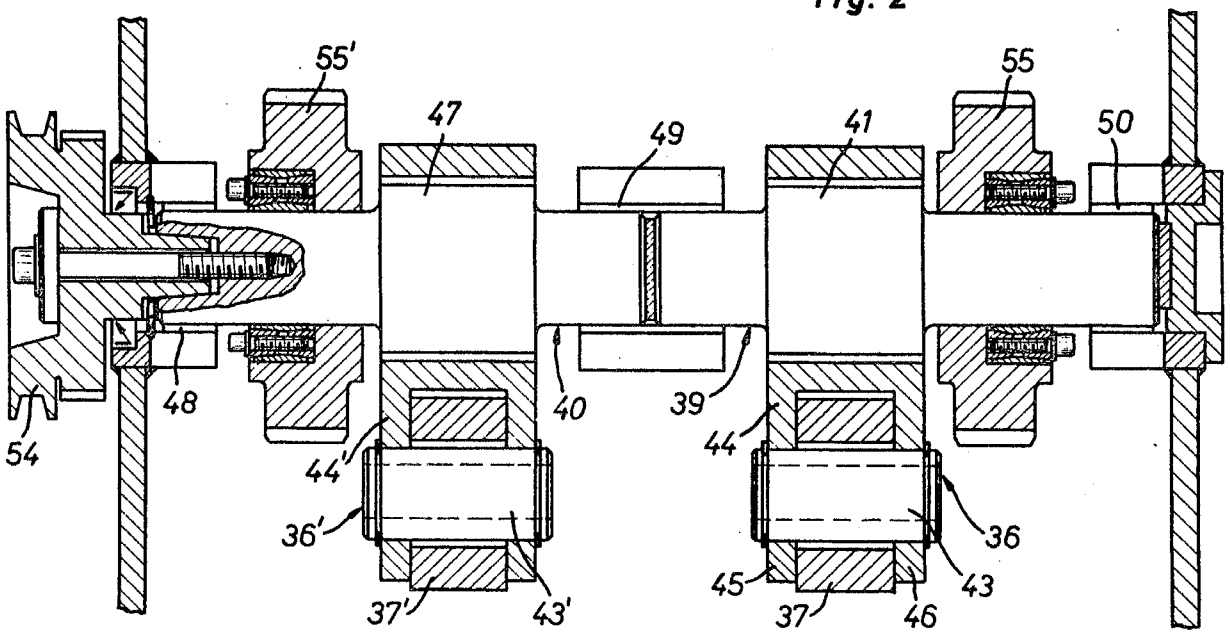
FIG. 2 a cross-section in the direction of the eccentric shaft through a reciprocating engine with two mutually parallel engine units in accordance with the illustration of FIG. 1 arranged mutually parallel.
Figure 3:
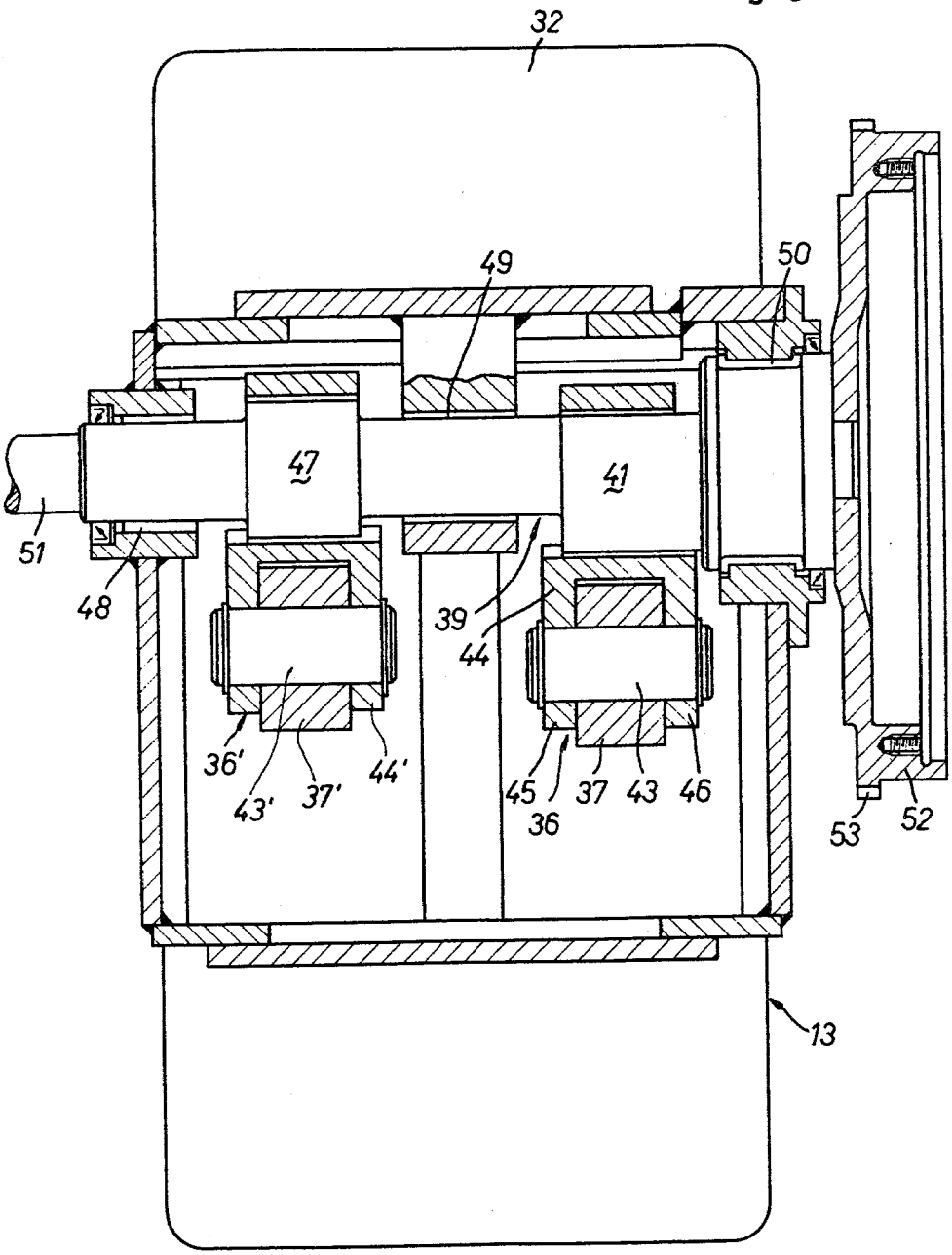
FIG. 3 a cross-section in the direction of the eccentric shaft of an embodiment in which two engine units are arranged in series and where the eccentric shaft is the main output shaft of the combined engines.

FIG. 2 shows a section through the engine which is passed through the eccentric shaft 39 and the linkage stub shaft 43. The drive connection between the lever arm 37 or the linkage stub shaft 43 and the eccentric 41 results through the forked shank of 44 in which the beam arm 37 is held by the stub shaft 43.

In an eight cylinder embodiment of the engine, the eccentric shaft 39, and correspondingly also the eccentric shaft 40 of the other eccentric mechanism, is lengthened to include a second series eccentric 47, to which an eccentric mechanism 36', 35' of the second four cylinder engine unit is connected. Through the mechanical advantage corresponding to the location of the eccentric mechanism 36 on the beam arm 37, there can be transmitted through the eccentric mechanism substantially greater forces at lower speed than are operating on the lever ends 20,21. Since the eccentricity of the eccentric 41,42 is relatively small, the torque acting on the eccenter shaft 39 is transmitted with relatively large force, which can be controlled without difficulty by corresponding dimensioning of the simply designed shaft and its bearings 48,49,50. At one end of the eccentric shaft 39 there is a shaft extension 51 for the driving of the adjacent unit of the engine, such as for example the air supply of a combustion engine, a generator, and others. At the other end of the eccentric shaft there is fastened a flywheel 52 which can be engaged in its ring gear 53 by a powered vehicle starter motor, not shown.

In order to overcome the dead spot of the thereby not immediately driven other eccenter mechanism during starting of the engine, there can be provided between both eccentric mechanisms a drive connection, such as for example by means of gears or a belt drive. This drive connection can consist of three gears, which are shown in the FIG. 1 in broken lines 55, 56,58. The gears 55 and 58 are fastened to the eccentric shafts 39 and 40, while the gear 56 is rigidly fastened to the beam pivot axle 23 in order to drive it. For this, the two ends of the lever axle 23 are rotatably mounted on bearings, not shown. Since the lever axle 23 is continually shifted rotationally, a continuous lubricating film can be readily held between the lever axle 23 and the lever 22.

Since an eccentric mechanism 35, 36 engages each of the lever arms 37, 38, but only one of the two serves to transmit the output or input of the useful torque, the other eccentric shaft of the other eccentric mechanism can serve for driving the cam shaft for the valve control, not shown, or for auxiliary units.

Both eccentric shaft parts 39,39' of two adjacent parallel engine units in accordance with the illustration in FIG. 1 are connected to drive the pivot axis shaft 23 of the engine by the gears 55,55', each of which engages a gear 56. The main shaft is thus at the same time also the beam pivot axle 23 of the beam 22. In the FIG. 1 the gears 55 and 56 are indicated by broken lines. It is understood that the relative dimensions of the gears 55,56 engaging with each other can be chosen as desired so that the rotational speed of the main shaft 23 is determined.

For overcoming the dead point of the second eccentric mechanism when starting the engine in motion from a standstill, both eccentric mechanisms are connected to be driven together. For this, the eccentric shaft 40 of the second eccentric mechanism, for example, carries likewise a gear 58 which through a gear 56 of the main shaft is connected to drive a gear 55 of the other eccentric shaft 39. The gear 58 engages only loosely with play, so that the second eccentric mechanism does not also drive the main shaft.

By the appropriate choice of the transmission conditions between the gear connected with the main shaft and the gear driven by the eccentric mechanism, the torque and speed of rotation of the main shaft can be determined. Independently of this, there is also the possibility of determining the torque and rotational speed of the eccentric mechanism by choice of the point of its connection to the beam. The closer the point of connection is to the beam pivot axis, the greater is the torque. In this way, it is possible even with a very high piston speed for the eccenter shaft or the main shaft to have a high torque and a relatively low rotational output shaft speed. This makes possible motor vehicle engines with a small displacement, a high performance, and much flexibility. The arrangement of the main output shaft centrally also provides advantages in balancing the mass of the moving parts, which advantages are construction advantages of particular significance in the incorporation of the engine in motor vehicles.

A second engine unit, which is not shown but which is substantially similar in construction to the engine described in connection with FIG. 1, can have its main shaft 23' connected to the main shaft 23 of the described and always running engine according to FIG. 1 through a controllable shaft coupling according to the illustrations of FIGS. 4 and 5. The one part of the shaft 23 has at its end the configuration of a bell 106, the outer surface of which glides in a bearing 108. The bell 106 serves to receive and bear the widened end 110 of the part of the other shaft 23', at the inner surface of which there is arranged a bearing sleeve 119 enclosing the end 110. The shaft end 110 has a cup-like depression in the front end 110 for receiving a linkage mechanism which has a conical release member 112 and two engagement balls 114,116. At two locations in the circumference of the cup-like shaft end 110, for example at locations displaced by 140 degrees, there are radially extending cylindrical bores 118,120 through which the engaging balls can be pushed radially toward the outside through the release member 112, so that they engage in two depressions 122, 124 in the wall of the bell 106. The depressions 122,124 may be, for example, hemispherical.

The engagement of the balls 114, 116 is possible only when the two shafts 23,23' have been brought to nearly the same rotational speed. For equalizing the rotational speed of the shafts 23,23' there is provided a special mechanism, shown in FIG. 4, to which there belong two pistons 130,132 guided in the radial bores 126,128 of the shaft end 110. Four or more such pistons are more effective than just two. The speed equalization is brought about in that both pistons 130,132 are pressed outwardly hydraulically against the curved inner race 134 formed in the inner side of the bell 6 of the other shaft 23.

For control of the hydraulic pressure there is provided a control pushrod 136 for control of the coupling. A hydraulic passage extends through the pushrod 136 axially from its outer end. At the inner end there connect to the passage two radial outflow channel segments 140,142.

Figure 4:
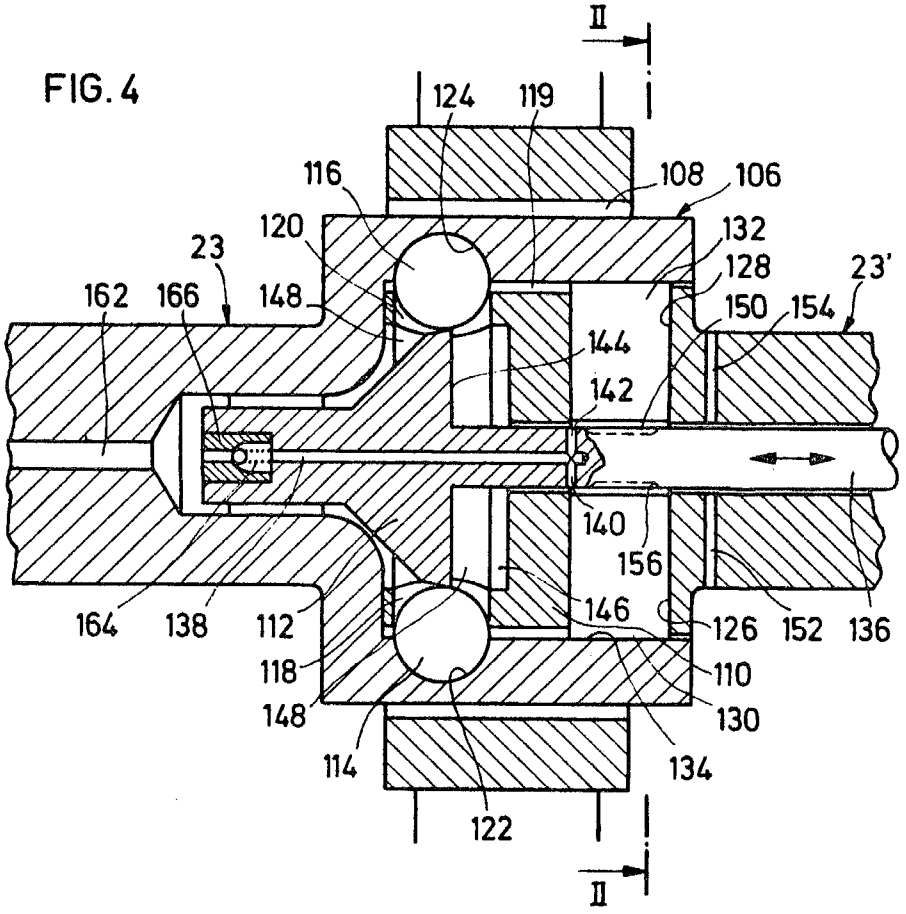
FIG. 4 an axial section through a coupling between the main shafts of two engine units in series, and FIG. 5 a section in the plane II—II of FIG. 4, but with the piston elements of the coupling in a different rotational position.

When the shaft 23' is at rest, the axially slideable push rod 136 is positioned to the right according to the illustration in FIG. 4, so that the end surface 144 rests against the radial inner surface 146 of the shaft end 110. In addition, the pistons 130,132 are in an inner radial position within the shaft end 110, so that the ball 106 of the shaft end 23 can rotate freely with the shaft part 23' at rest. This inner radial position of the pistons 130,132 is possible since the oil channel 138 is connected with the radial outflow canals 152,154 of the shaft end 110 through the radial canal segments 140,142 and a circumscribed groove 150 in the circumference of the push rod 136. The groove 150 of the push rod 136 extends along a limited axial length, so that it ends up in the right position of the push rod in the region of release canals 152,154. When the push rod 136 is pushed to the left, in the direction toward the turning shaft end 23, as in FIG. 4, then the end 156 of the groove 150 is pushed away from the radial release canals 152,154, so that there can be build up in the groove 150 an oil pressure which acts on the inner end 158,160 of the pistons 130,132, since the groove 150 is at least in part in the region of the pistons. The oil pressure arises from the supply pressure of, for example, the lubricating oil pump 184 of the engine unit in accordance with FIG. 1, which can also supply the sleeve bearings of the engine units. The oil streams through the axial canal 162 toward the shaft part 23 of the first engine unit, which features the accessories, and in so doing overcomes the pressure of the spring 164 of a check valve 166 which is at the entrance end of the hydraulic canal 138 of the push rod 136. The check valve 166 is for preventing a back-streaming of oil under pressure resulting from movement of the pistons 130,132. Such movement occurs during the gliding of the rounded ends 168, 170 of the pistons along the race 134. In the transition of the gliding movement of the piston ends from, for example, the circular portion 172 of the race 134 as shown in the FIG. 5 to the planar portion 174, there operates on the rounded end of each of the pistons a force of which the component tangential to the shaft end 110 result in a torque at the shaft end 23', so that it is put into rotational movement. The radially directed components of this force cause the described movements of the pistons 133,132 against the pressure of the oil. The relative movement between the piston ends and the curved race becomes smaller with increasing rotational speed of the driven shaft end 23' until both shaft parts 23,23' have the same rotational speed. At this point the push rod 136 can be pushed so far in the direction of the driven shaft part 23 that the balls 114,166 can reach through the action of the conical release member 112 the engagement position shown in FIG. 4. Since by reason of their angular displacement of, for example 140 degrees, the balls can engage in the depressions 122,124 in only one relative angular position of the ends of the shafts 23,23', the shafts 23,23' are thereby engaged only in a predetermined fixed relative position and there thus is formed an 8 cylinder internal combustion engine with a corresponding piston sequence between each of the now combined four cylinder working engine units.

Figure 5:
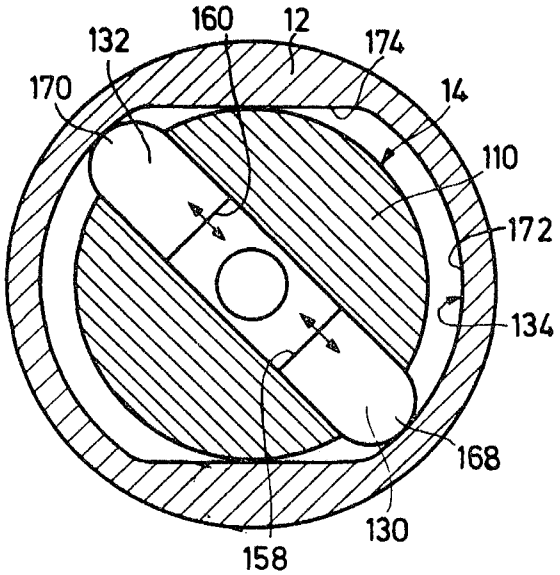

The described embodiment of the shaft coupling in accordance with FIGS. 4 and 5 is particularly suited to connect the main shafts of both engine units, since its diameter is only slightly greater than the diameter of the two main shafts 23,23', and since it also simultaneously serves as a bearing point for both shafts 23, 23'. In addition, such a shaft coupling does not require additional clearance in the direction of the shafts, so that the choice of the spacing between the two engine units in accordance with FIG. 1 is independent of the construction of the shaft coupling and can be the same as for a single uninterrupted main shaft connecting two engine units.

We claim:

1. A reciprocating combustion engine including at least one engine unit comprising: at least two cylinder assemblies each defining a generally centrally located rectilinear longitudinal axis, said cylinder assemblies being located spaced apart alongside each other with said longitudinal axes extending generally parallel to each other, each of said cylinder assemblies comprising housing means defining a pair of coaxial cylinders of generally equivalent size; a first and a second pair of pistons operatively arranged, respectively, in each of said cylinder assemblies, with each one of the pistons of said piston pairs being operatively associated with one of each of said cylinders; a longitudinal beam having a first and a second end; central support means pivotally supporting said beam about a pivot axis located equidistantly between said first and said second end of said beam; connecting rod means operatively connecting each of said pairs of pistons to one of said ends, respectively, of said longitudinal beam, with said pistons operating within said cylinders to drive said beam to reciprocally pivot said beam about said central pivot axis; power output shaft means for said engine unit arranged to be rotatively driven relative to said housing means defining said cylinders; a primary eccentric mechanism connected to said longitudinal beam at a location thereon intermediate said first end of said beam and said central pivot axis, said primary eccentric mechanism being connected to effect transmission of power between said longitudinal beam and said power output shaft means of said engine unit; and balancing means connected to said longitudinal beam at a location thereon intermediate said second end of said beam and said central pivot axis providing a balancing effect against the effect of said primary eccentric mechanism, said balancing means and the other moving parts of said engine being arranged so that the common center of mass of the moving parts of said engine is located substantially on said central pivot axis of said beam and within a plane having therein both said rectilinear axes of said cylinder assemblies; said primary eccentric mechanism being connected to said beam at a point spaced a greater distance from the connection of said connecting rod means to said first end of said beam than from said central pivot axis.

2. The engine according to claim 1, wherein said balancing means comprises a balancing mass which is fixed to said second arm.

3. The engine according to claim 1, wherein said pivot axle is mounted so that it can rotate and is continuously rotated in one direction, so that a continuous lubricating film is formed between said beam and said axle.

4. The engine according to claims 1 or 2, wherein said axle forms the main power shaft of said engine and is driven by said primary eccentric mechanism.

5. The engine according to claim 1, wherein said pistons of each pair are rigidly connected together as a unit so that they guide each other within their respective cylinders and said end regions of said arms are each connected to one of said piston units through a ball-and-socket bearing.

6. The engine according to claim 1, wherein a plurality of said engine units are arranged together to form said engine as a multiple-unit engine and wherein said primary eccentric mechanisms of said engine units drive a common main power shaft.

7. An engine according to claim 1 wherein said power output shaft means comprise an eccentric shaft of said primary eccentric mechanism.

8. An engine according to claim 1 wherein said power output shaft means comprise a central pivot axle defining said pivot axis of said beam and having said beam pivotally supported thereon.

9. An engine according to claim 8 wherein said balancing means comprise a secondary eccentric mechanism wherein one of said primary and secondary eccentric mechanisms is connected to effect power transmission to said power output shaft means.

10. The engine according to claim 4, wherein said balancing means is a secondary eccentric mechanism, similar to said primary eccentric mechanism and connected to said second arm of said beam at a point symmetrical to the point of connection of said primary eccentric mechanism with respect to said axis of said pivot axle.

11. The engine according to claim 10, wherein eccentric shafts of said primary and secondary eccentric mechanisms are rotatably connected together to overcome a dead position on starting.

12. The engine according to claim 10, wherein an eccentric shaft of said primary eccentric mechanism is adapted to transfer power from said beam as the primary power output of said engine and said secondary eccentric mechanism is connected at least to a cam shaft for operating valves in a cylinder head of said engine.

13. A reciprocating combustion engine including a plurality of engine units arranged together to form said engine as a multiple-unit engine, each of said units comprising: at least two cylinder assemblies each defining a generally centrally located rectilinear longitudinal axis, said cylinder assemblies being located spaced apart alongside each other with said longitudinal axes extending generally parallel to each other, each of said cylinder assemblies comprising a pair of coaxial cylinders of generally equivalent size; a first and a second pair of pistons operatively arranged, respectively, in each of said cylinder assemblies, with each one of the pistons of said piston pairs being operatively associated with one of each of said cylinders; a longitudinal beam having a first and a second end; a central pivot axle located equidistantly between said first and said second end of said beam having said beam pivotally mounted thereon; connecting rod means operatively connecting each of said pairs of pistons to one of said ends, respectively, of said longitudinal beam, with said pistons operating within said cylinders to drive said beam to reciprocally pivot said beam about said central pivot axle; a rotating primary power shaft for said engine unit; a primary eccentric mechanism connected to said longitudinal beam at a location thereon intermediate said first end of said beam and said central pivot axle, said primary eccentric mechanism being connected to effect transmission of power between said longitudinal beam and said rotating primary power shaft of said engine unit; and balancing means connected to said longitudinal beam at a location thereon intermediate said second end of said beam and said central pivot axle providing a balancing effect against the effect of said primary eccentric mechanism, said balancing means and the other moving parts of said engine being arranged so that the common center of mass of the moving parts of said engine is located substantially on a rectilinear axis defined by said central pivot axle of said beam and within a plane having therein both said rectilinear axes of said cylinder assemblies; said engine further comprising a controllable coupling operatively interposed between said power shafts of each of said engine units to effect selective mutual engagement and disengagement of said engine units to enable said engine to operate with one or more of said engine units providing power therefor; said coupling comprising a synchronizing mechanism for equalizing the rotational speeds of both said power shafts and also a mechanism for connecting together said shafts when the speeds are synchronized; said synchronizing mechanism comprising one piston element which is radially movable hydraulically, the outer end of said piston element gliding over a race surface in response to hydraulic pressure and upon synchronization assuming a position on said race surface which has a maximum radial displacement from the axis of said power shaft.

14. The engine according to claim 13, wherein said coupling comprises fixed to the main shaft of one of said engine units an outer part with a cylindrical inner surface which forms a bearing surface of a bearing which bears in said coupling the end of the main shaft of another of said engine units.

15. The engine according to claim 13, wherein said coupling comprises fixed to the end of the main shaft of one of said engine units an outer portion having a cylindrical outer surface which forms a bearing surface of a bearing fastened in a housing common to both of said engine units.

16. The engine according to claim 12, wherein the ends of both of said main shafts comprise cup-shaped portions of which one is borne inside the other.

17. The engine according to claim 13, wherein hydraulic control of the movement of said hydraulic piston element is provided by a push rod guided axially through one of said main shafts, said push rod being provided with a channel system including a channel segment extending radially outward to said piston element.

18. The engine according to claim 17, wherein there is a check valve in the channel system of said push rod, said check valve being disposed at an input end of a hydraulic channel of said push rod.

19. The engine according to claim 17, wherein there is provided on said push rod a release element for releasing said main shafts from mutual engagement.

20. The engine according to claim 19, wherein said release element is conical, so that as a result of axial movement of said release element said engaging elements are movable radially outward to an engagement position.

21. The engine according to claim 13, wherein said mechanism comprises two engaging elements which engage in depressions.

22. The engine according to claims 21 or 20, wherein both of said engaging elements are mutually angularly displaced about the axis of said release element by an angle by which the total circumference angle of 360 degrees is unevenly divisible, so that engagement can occur only at a single predetermined relative angular orientation of said main shafts.

23. The engine according to claims 13 or 17, wherein a hydraulic pressure source for said hydraulic control comprises a lubricating oil pump for at least one of said engine units.

* * * * *